US006532887B1

(12) United States Patent
Venier et al.

(10) Patent No.: US 6,532,887 B1
(45) Date of Patent: Mar. 18, 2003

(54) SMALL DEVICE LAUNCH SYSTEM

(75) Inventors: Nicholas O. Venier, Tiverton, RI (US); Nicholas Bitsakis, Seekonk, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 17 days.

(21) Appl. No.: 09/968,017

(22) Filed: Oct. 1, 2001

(51) Int. Cl.[7] ..... B63G 8/00

(52) U.S. Cl. ..... 114/312; 114/318

(58) Field of Search ..... 114/319, 316, 114/318, 238, 317, 239, 312; 89/1.809, 1.81

(56) References Cited

U.S. PATENT DOCUMENTS 5,165,380 A * 11/1992 Moody ..... 117/319

* cited by examiner

*Primary Examiner*—Ed Swinehart
(74) *Attorney, Agent, or Firm*—James M. Kasischke; Michael F. Oglo; Jean-Paul Nasser

(57) ABSTRACT

A system for providing pressurized fluid for a small device launch system is shown. The system includes a piston housing an air source aperture, a launcher bore, and a shaft aperture. A piston and piston shaft slide in the chamber with the piston shaft extending out the shaft aperture. A hydraulic control cylinder is connected to the piston shaft and a controller is joined to control the cylinder. In a preferred embodiment, the controller controls flow through a variable restriction valve positioned in hydraulic communication between sides of the hydraulic cylinder. A position indicator can also be provided for communicating the position of the piston shaft to the controller.

12 Claims, 4 Drawing Sheets

SMALL DEVICE LAUNCH SYSTEM

STATEMENT OF GOVERNMENT INTEREST

The invention described herein may be manufactured and used by or for the Government of the United States of America for governmental purposes without payment of any royalties thereon or therefor.

CROSS REFERENCE TO OTHER PATENT APPLICATIONS

Not applicable.

BACKGROUND OF THE INVENTION

1. Field of the Invention

The present application is related to a system and method of launching small devices from a submarine and, in particular, to a system and method of launching small devices from a submarine with a minimal acoustic signature.

2. Description of the Prior Art

Generally, small device launch systems generate what is known as a "water hammer," which is a waterborne acoustic signal. One example of such a small device launching system is illustrated herein with references to FIGS. 1 and 2. This system includes a tank 10 with an internal piston chamber 12 defined by a chamber wall indicated generally at 14, which is generally cylindrical and includes opposing chamber end wall 16 and stroke wall 18, which conform to the shape of chamber wall 14. A plurality of bumpers 20 are generally disposed within piston chamber 12 on the opposing walls 16 and 18.

At end wall 16, piston chamber 12 is fluidly connected to a high pressure air source (not illustrated) by a passageway 24. At stroke wall 18, piston chamber 12 is fluidly connected to a conventional launch tube (not illustrated) by a launcher bore 26 having generally cylindrical sidewall 28 along which a plurality of deceleration discs 30 are disposed.

A piston indicated generally at 32 is slidably disposed within piston chamber 12. Piston 32 has a cross-sectional shape generally conforming to chamber wall 14, and is supported on a piston shaft 34. Piston 32 and piston shaft 34 are co-axially disposed within piston chamber 12. Piston 32 includes opposing surfaces 36, 38 which will be referenced hereinafter as air side surface 36 and water side surface 38. Water side surface 38 of piston 32 includes a cylindrical extension 40 having a conical end 42.

In operation, when it is desired to launch a device from a launch tube (not illustrated), high pressure air from the high pressure air source is delivered to piston chamber 12 through passageway 24. The air is delivered at a pressure greater than sea pressure at the depth of the submarine. Thus, as shown in FIG. 2, piston 32 is forced toward stroke wall 18, compressing water adjacent water side surface 38 of piston 32 through launcher bore 26 and into the breech end of a launch tube connected to the system. The movement of the water creates a pressure imbalance between the breech end of a device in the launch tube and, as a result of the pressure imbalance, the device is ejected from the launch tube.

Of course, as the depth of the submarine increases, so does the sea pressure, which increases the pressure on the muzzle end of the launch tube. As a result, the pressure requirement for satisfactorily effecting the launch of a device from the launch tube increases with the depth of the submarine. In addition, when piston 32 impacts stroke wall 18, the system hardware is shock loaded and a high level airborne and waterborne acoustic signature is generated, as described above.

In order to minimize such undesirable effects, rubber bumpers 20, as described above, are generally incorporated into both end walls 16, 18 of piston chamber 12.

In addition, deceleration discs 30 work in conjunction with conical end 42 of extension 40 to restrict the flow of water from water side surface 38 of piston 32, to the launch tube, at the end of the stroke. As piston 32 moves toward stroke wall 18, an increasing number of deceleration disks 30 are effectively sealed against fluid flow by extension 40. As a result, the pressure increases on water side surface 38 of piston 32. The increasing pressure counteracts the high air pressure on air side surface 36 of piston 32, in an attempt to decelerate the rate at which the piston 32 travels and hits stroke wall 18.

Despite the deceleration effected by the bumpers 20 and the deceleration disks 30, a column of water in launcher bore 26 leading to the launch tube continues to flow in the direction of the launch tube. The momentum of the column of water creates a low pressure region proximate the tank in the region of the launch tube in closest proximity to launcher bore 26. The low pressure region results in an abrupt stop of water flow in launcher bore 26, which creates cavitation or a water hammer.

Various fluid filled piston assemblies are provided in the prior art. These include:

U.S. Pat. No. 5,004,264 to Kozaki et al. discloses a piston control device in which a fluid-operated valve controls the position of a piston in a fluid-filled cylinder.

U.S. Pat. No. 5,107,969 to Klein et al. discloses a controllable vibration damper having a fluid filled cylinder with a piston disposed therein. A control valve is provided in the piston for regulating fluid flow across the piston interface.

U.S. Pat. No. 5,174,236 to Moody discloses a torpedo launch system using synthetic cushions as piston brakes.

U.S. Pat. No. 5,337,864 to Sjostrom discloses a suspension system used as a fluid-filled piston assembly in which upper and lower chambers thereof are coupled to one another via a throttle valve.

U.S. Pat. No. 5,392,882 to Mackovjak et al. discloses a suspension strut in which a spring-loaded mass divides a fluid-filled cylinder into two chambers that are coupled to one another by a valve.

U.S. Pat. No. 5,810,125 to Gezari discloses an active shock absorber seating system which can decelerate a piston based on the position of the piston's hydraulic cylinder.

None of these devices provides a means for controlling water hammer in a small device launcher.

SUMMARY OF THE INVENTION

It is a first object of this invention to provide a small device launcher incorporating a means for avoiding water hammer.

It is another object of this invention that such launcher be configurable to different launch profiles.

It is yet another object of this invention that such added capabilities be provided with minimal modification of existing small device launchers.

Accordingly, this invention provides a system for launching a small device from a submarine, including a chamber fluidly connected to a high pressure air source and to a launcher bore, a first piston disposed within the chamber, the piston being connected to a piston shaft. A piston shaft extension is connected to the piston shaft and extends through an aperture in the housing. A hydraulic control cylinder is operatively connected to the piston shaft extension. A controller is included for controlling the relative movement of the hydraulic control cylinder. The hydraulic control cylinder is responsive to the controller and controls the relative position of the piston shaft extension.

Another embodiment is directed to a small device launching system. The system includes a housing having an air source port and a launcher-bore, and a piston shaft aperture disposed coaxially within the housing. The system also includes a piston slidably disposed in the housing between the air source port and the launcher bore. A piston shaft is joined to the piston, and at least a portion of the piston shaft extends outside of the housing through the piston shaft aperture. A hydraulic braking assembly is joined to the portion of the piston shaft extending outside of the housing. A position indicator is joined to the piston shaft and provides a signal responsive to the position of the piston. The controller is joined to receive the signal from the position indicator. The controller is joined to control the hydraulic braking assembly.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DESCRIPTION OF THE PREFERRED EMBODIMENTS

The present invention is directed to an improved system for launching relatively small devices from a submarine, with a minimal acoustic signature.

As stated above, in some situations, a water hammer is inconsequential or desired. For example, small device launch systems may be used for distress buoys, marker buoys, broad band jammers, and other devices intended to reveal the position of a ship. However, small device launchers are also used with a myriad of devices and in situations in which a covert launch is desirable and a water hammer is detrimental, such as, for example, bathythermographs, time delay jammers and decoy devices. In these situations, a water hammer is detrimental to the ship because it provides a readily detectable acoustic signature by which the position of a submarine may be determined. In addition, a water hammer may be detrimental to the system because the transmittal shock and vibration loads are transmitted to mechanical parts.

The present system minimizes the accelerations and decelerations associated with launching a small device and reduces or eliminates the water hammer. The present system and method provide reduced shock and vibration loads in comparison to other systems, such that system loads are reduced and possible ship detection is reduced. The system may be incorporated into existing designs with minimal cost. The system includes a piston acceleration/deceleration control that may be easily modified to account for individual ship/system idiosyncrasies.

Figure 1:
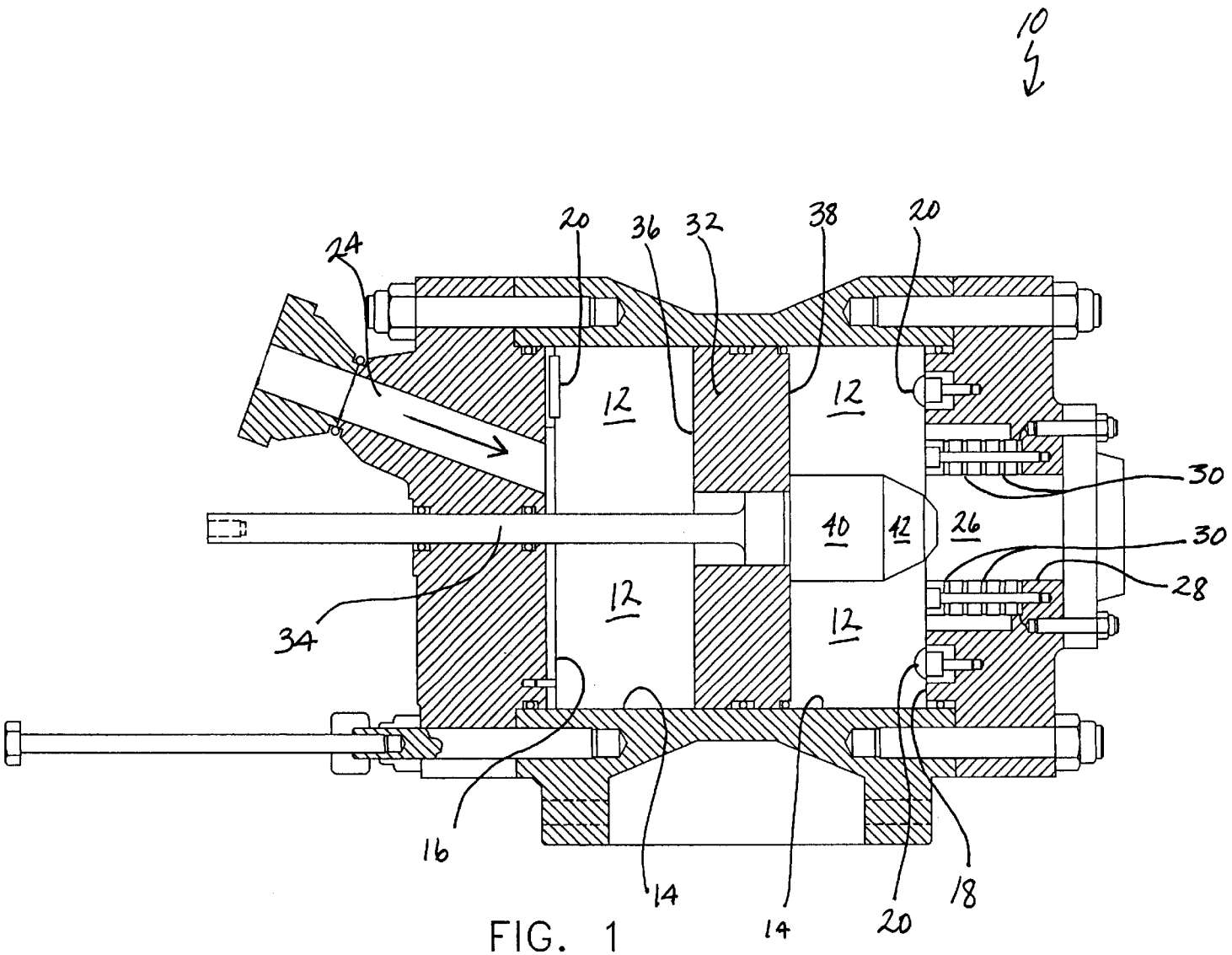
FIG. 1 is a cut away view of an existing small device launch system with the piston in an intermediate position.
Figure 2:
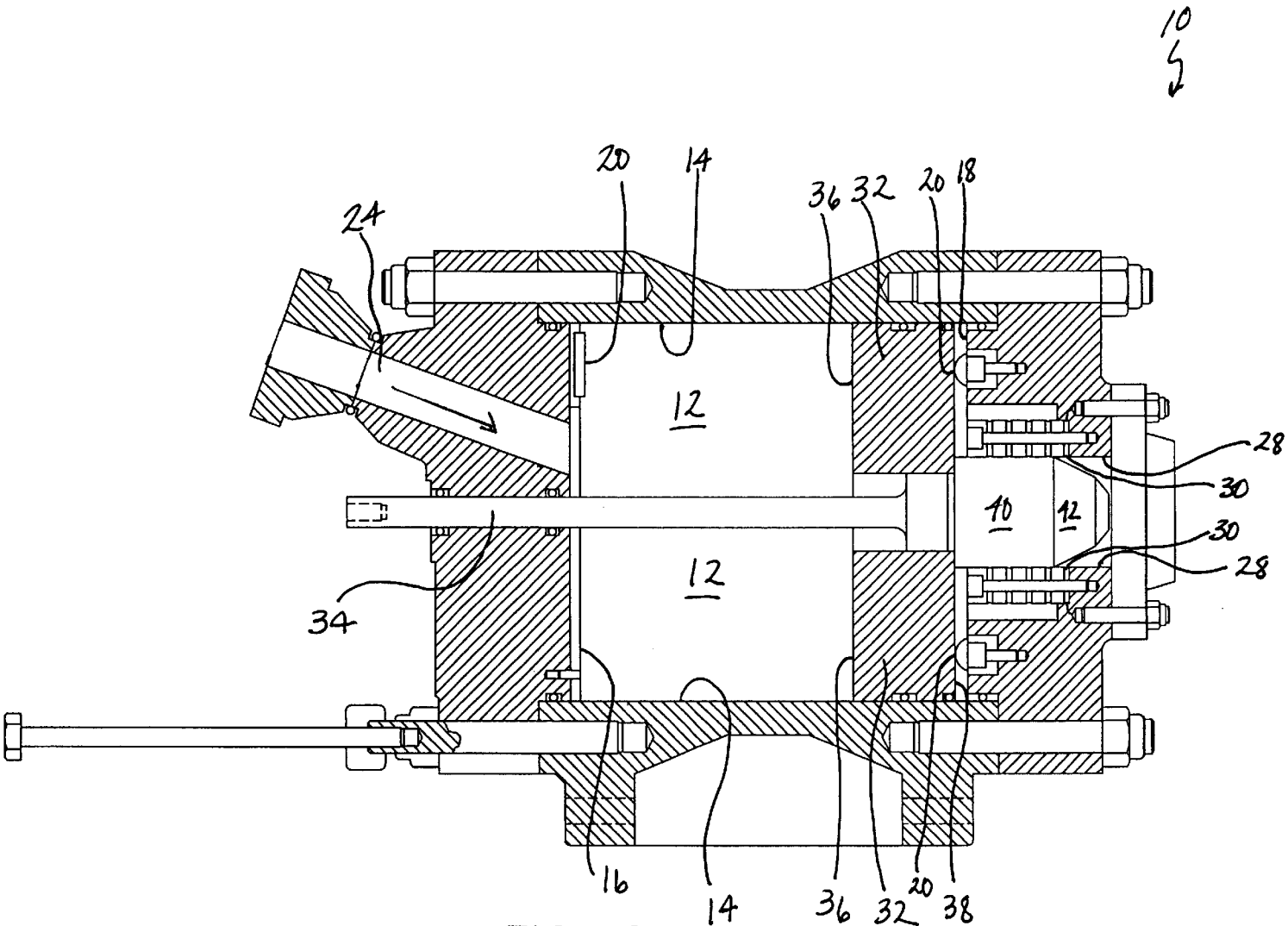
FIG. 2 is a cut away view of the small device launch system of FIG. 1 with the piston in a launch position.
Figure 3:
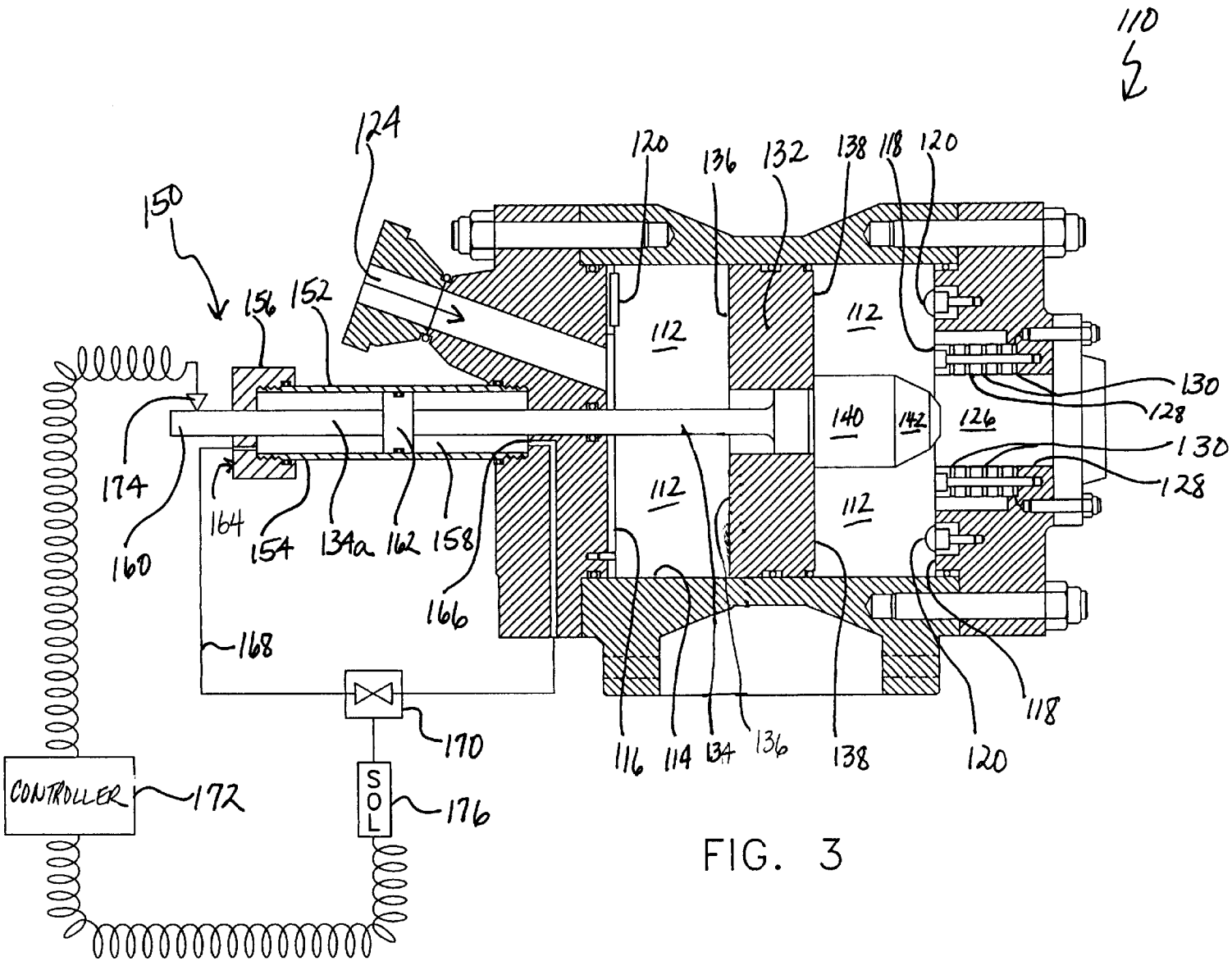
FIG. 3 is a cut away view including a schematic diagram of a small device launch system according to the present invention with the piston in an intermediate position.
Figure 4:
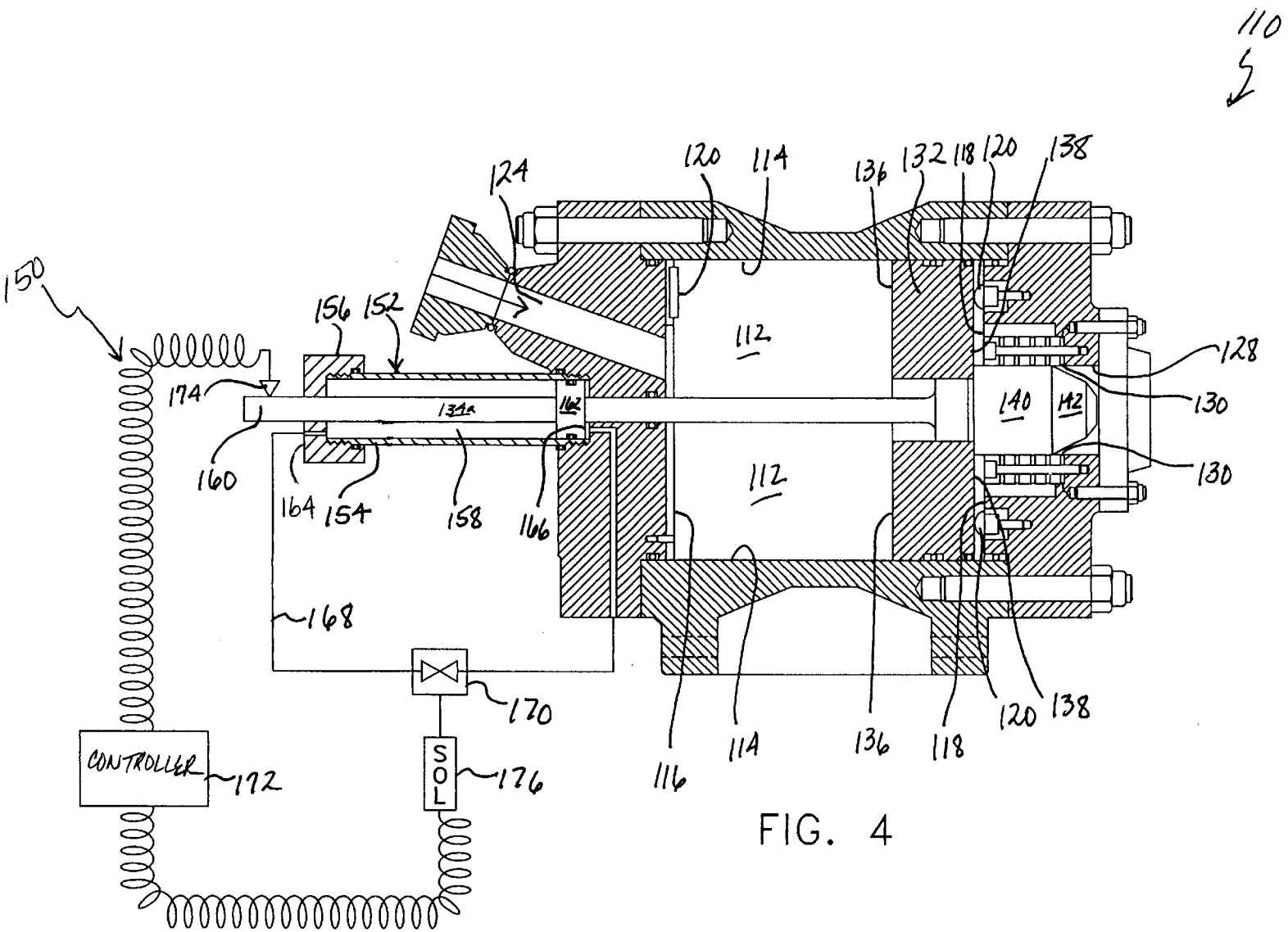
FIG. 4 is a cut away view including a schematic diagram of the small device launch system of FIG. 3 with the piston in a launch position.

FIGS. 3 and 4 illustrate cut away views of the present small device launch system with a schematic diagram providing additional details of the present invention, which includes a tank 110 with an internal piston chamber 112 defined by a chamber wall indicated generally at 114. Chamber wall 114 is generally cylindrical and includes opposing chamber battery end wall 116 and stroke end wall 118. Walls 116 and 118 conform to the shape of chamber wall 114. A plurality of bumpers 120 are generally disposed within piston chamber 112 on the opposing walls 116,118.

At battery end wall 116, piston chamber 112 is fluidly connected to a high pressure air source (not illustrated) by a passageway 124. At stroke end wall 118, piston chamber 112 is fluidly connected to a conventional launch tube (not illustrated) by a launcher bore 126 having generally cylindrical sidewall 128 along which a plurality of deceleration discs 130 are disposed.

A piston indicated generally at 132 is slidably disposed within piston chamber 112. Piston 132 has a cross-sectional shape generally conforming to chamber wall 114, and is supported on a piston shaft 134. Piston shaft 134 is elongated in comparison to the prior art embodiment, and includes a piston shaft extension portion 134*a* extruding through the battery end wall 116. Piston 132 and piston shaft 134 are coaxially disposed within piston chamber 112. Piston 132 includes opposing surfaces 136, 138 which will be referenced hereinafter as air side surface 136 and water side surface 138. Water side surface 138 of piston 134 includes a cylindrical extension 140 having a conical end 142.

In addition to the foregoing, system 110 includes an automatic hydraulic brake assembly indicated generally at 150. Hydraulic brake assembly 150 includes a control cylinder indicated generally at 152. Control cylinder 152 includes a housing 154 and an end cap 156 defining an interior chamber 158 containing hydraulic fluid (not illustrated). Piston shaft extension 134*a* of piston shaft 134 extends through battery end wall 116 into interior chamber 158 of control cylinder 152 and through end cap 156 to define piston shaft extension 160, to which a control piston 162 is connected and disposed within interior chamber 158.

Control cylinder 152 includes opposing ends 164, 166, each fluidly connected by a hydraulic pipe line 168. A variable restriction valve 170 is fluidly connected to the hydraulic pipe line 168.

A controller 172 is connected to piston shaft extension 160 by a position sensor 174, and also connected to variable restriction valve 170. A solenoid 176 is positioned between controller 172 and variable restriction valve 170 for adjusting valve 170 in response to a signal from controller 172. Position sensor 174 may be a mechanical position indicating device, such as wheel, or an electronic position indicating device, such as a magnetic or photoelectric device.

In operation, the position and direction of motion (if any) of piston shaft extension 160 and correspondingly piston 132, can be determined by signals generated from position sensor 174. These position indicating signals are transmitted to controller 172. Upon receiving position indicating signals, controller 172 provides a control signal to solenoid 176 for controlling variable restriction on valve 170. Thus, position of piston shaft extension 160 and correspondingly piston 132 may be sensed by variable position sensor 174 and used to control the flow of hydraulic fluid into cylinder 154. Restricted flow in valve 170 creates a hydraulic braking affect on piston 162. In this manner, the acceleration/deceleration of piston shaft extension 160 and correspondingly piston 132 may be controlled. Thus, depending on the position of piston shaft extension 160 and correspondingly piston 132, valve 170 may be adjusted, with respect to time, from fully open to fully closed. Controller 172 can also be joined to receive a firing command and adjust the valve 170 in a preprogrammed manner without reference to the position sensor. Controller 172 may be pre-programmed to minimize the end of stroke mechanical impact of piston 132 against stroke wall 118 and thereby the water hammer generated during acceleration and deceleration of piston 132.

Alternatively, control cylinder 152 may be mounted separately from tank 110. In addition, controller 174 may control variable restriction valve 170 directly. Finally, the system may be constructed without bumpers or deceleration disks to reduce system complexity and cost.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A system for providing pressurized fluid comprising:

a chamber having an air source aperture therein for fluid connection to a high pressure air source, a launcher bore therein for provision of high pressure fluid thereto, and a shaft aperture therein;

a first piston disposed within said chamber;

a first piston shaft joined to said piston and extending through said shaft aperture in said chamber;

a hydraulic control cylinder operatively connected to said piston shaft for applying axial force to said piston shaft; and a controller joined to said hydraulic control cylinder and controlling the force applied by said hydraulic control cylinder.

2. The system of claim 1 wherein:

said hydraulic control cylinder has a first side and a second side;

said system further comprising:

a variable restriction valve joined to restrict fluid flow between said hydraulic control cylinder first side and said hydraulic control cylinder second side, said variable restriction valve being operatively connected to said controller for restricting fluid flow on command from said controller; and hydraulic fluid in said hydraulic control cylinder and said variable restriction valve.

3. The system of claim 2 further comprising a solenoid joined to receive a control signal from said controller and adjust said variable restriction valve based on said received control signal.

4. The system of claim 1 further comprising a positioning sensor joined in communication with said controller and positioned for monitoring a position of said piston shaft for transmitting a signal associated with said position of said piston shaft to said controller.

5. The system of claim 4 wherein:

said piston shaft has an optical pattern thereon; and said positioning sensor is an optical sensor positioned to view said optical pattern.

6. The system of claim 4 wherein:

said piston shaft has a series of detents formed thereon; and said positioning sensor is a mechanical counter positioned to count said series of detents.

7. The system of claim 4 wherein:

said piston shaft has a series of regions with positionally varying electromagnetic properties; and said positioning sensor is an electromagnetic sensor measuring said varying electromagnetic properties.

8. The system of claim 1 wherein said controller receives a launch control signal and controls the hydraulic control cylinder based on elapsed time from receipt of said launch control signal.

9. A system for providing pressurized fluid comprising:

a housing having an air source port, a launcher bore and a shaft aperture formed therein;

a piston slidably disposed in said housing between said air source port and said launcher bore;

a piston shaft joined to said piston, at least a portion of said piston shaft extending outside of said housing through said piston shaft aperture;

a hydraulic braking assembly joined to said portion of said piston shaft extending outside of said housing;

a position indicator joined to said piston shaft and providing a signal responsive to the position of said piston; and a controller joined to receive said signal from said position indicator, said controller being joined to control said hydraulic braking assembly.

10. The system of claim 9 wherein said hydraulic braking assembly comprises:

a braking housing having first and second apertures therein;

a braking piston slidably received within said braking housing, said braking housing first aperture being positioned proximate a first side of said braking piston and said braking housing second aperture being positioned proximate as second side of said braking piston;

a valve controlled by said controller and joined in fluid communication between said braking housing first aperture and said braking housing second aperture; and hydraulic fluid contained within said braking housing and said valve.

11. The system of claim 10 wherein said braking piston is joined to said piston shaft for directly restricting motion of said piston shaft.

12. The system of claim 10 further comprising a solenoid receiving a signal from said controller, said solenoid joined to operate said valve.

* * * * *